United States Patent [19]

Borisoff

[11] Patent Number: 4,535,670

[45] Date of Patent: Aug. 20, 1985

[54] STRING BENDER ATTACHMENT CONSTRUCTION

[76] Inventor: David J. Borisoff, 7726 Burnet Ave., Van Nuys, Calif. 91405

[21] Appl. No.: 610,553

[22] Filed: May 15, 1984

[51] Int. Cl.[3] ..... G10D 3/14

[52] U.S. Cl. ..... 84/312 R; 84/297 R; 84/299

[58] Field of Search ..... 84/312 R, 313, 267, 84/297-301

[56] References Cited

U.S. PATENT DOCUMENTS

| | | | |
|---|---|---|---|
| 1,924,854 | 8/1933 | Harmon | 84/312 R |
| 2,196,531 | 4/1940 | Larisch | 84/299 |
| 2,998,742 | 9/1961 | Pratt | 84/267 |
| 3,479,917 | 11/1969 | Zitnik et al. | 84/312 R |
| 3,686,993 | 8/1972 | Fender | 84/312 R |
| 4,397,212 | 8/1983 | Carson | 84/313 |

*Primary Examiner*—Lawrence R. Franklin

*Attorney, Agent, or Firm*—William W. Glenny

[57] ABSTRACT

A stringed bender attachment for selectively changing the tension imposed on a selected string of a string instrument of the guitar family including a frame attached to the instrument body opposite the neck of the instrument having mounted thereon a rod having an axis transverse to the axis of a selected string and a rocker arm pivotally mounted on the rod and having the end of the selected string anchored thereto. Pivotal movement of the rocker arm slightly changes the tension imposed on the selected string, and actuating means are provided including an extended arm actuable by body movement of the performer during play for bending or changing the tension on the selected string. A second bender means may be mounted on the rod for changing the tension of a second string by digital movement by the performer. Selectively adjustable means are provided for limiting the amount of change of tension.

2 Claims, 4 Drawing Figures

STRING BENDER ATTACHMENT CONSTRUCTION

BACKGROUND AND SUMMARY OF THE INVENTION

This invention relates generally to stringed musical instruments of the guitar family. More particularly the invention is directed to an attachment for a conventional guitar or the like by which the performer, during play, can bend, i.e. slightly change the pitch of, a selected string or strings.

The preferred form of the invention includes a mechanism by which the performer can actuate the bending function by body movement alone, and hence without interfering or interrupting complete manual and digital activity in playing the instrument. More particularly, holding the guitar in conventional fashion, typically but not necessarily supported by a neck strap, the performer moves his hips laterally. This movement serves to actuate an arm projecting from the instrument, and the motion of the arm is translated, by the mechanism of the present invention, to increasing the tension imposed on the selected string, thereby bending the pitch of that string. In the preferred form of the invention to be described and illustrated herein, the selected string is the second, but it will be understood that the invention is applicable to any string, as well as to any form of guitar, including acoustic and electric.

When the actuating force is removed from the arm, by reverse movement of the performer's body, the string returns to its original tension and pitch.

The attachment structure of the present invention provides convenient means for mounting an additional bending mechanism governing the pitch of a different string. In the present illustrative form of the invention the additional bending mechanism is finger-operated and bends the pitch of the sixth string, slightly lowering its pitch.

The attachment of the present invention can be readily mounted on a guitar by the user, and can be demounted when desired, without disfiguring or marring the surface of the guitar in any way. This is accomplished by the use of the existing lower strap attachment screw, provided with virtually all guitars.

The principal object of the invention is thus to provide a novel device for attachment to a guitar by which the performer, during play, can bend the pitch of a string. Other objects are to provide, in such a device, means permitting the performer to bend a string without any interference with his finger or hand movement; to provide such a device easily mountable on a guitar without the need for making screw holes or the like, which would disfigure the guitar if the attachment device were later removed; and for other and additional objects and purposes as will be understood from the following description of a preferred embodiment of the invention, taken in connection with the accompanying drawings.

DETAILED DESCRIPTION

Figure 1:
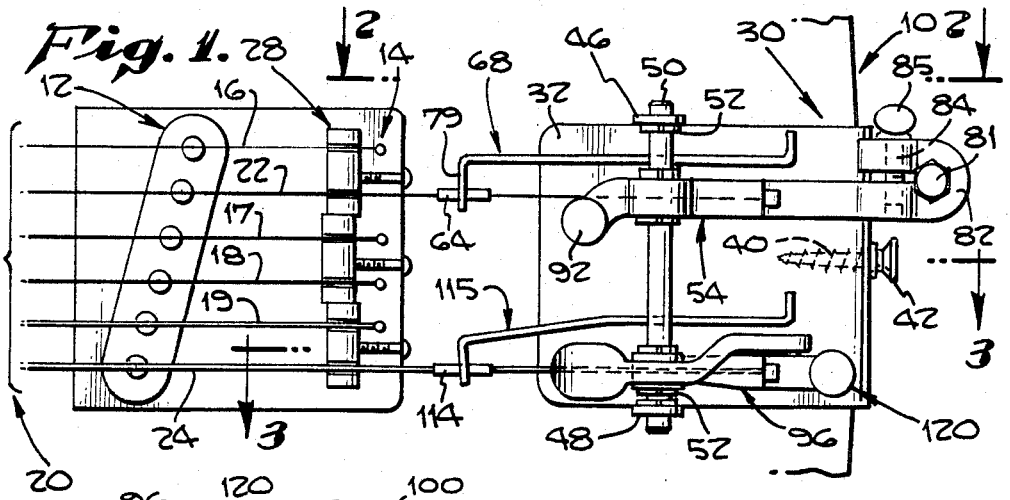
FIG. 1 is a top plan view of the attachment structure of the present invention mounted in operative condition on a guitar, partially shown.

In FIG. 1 the lower end of an electric guitar is indicated generally at 10 and includes a conventional array 12 of magnetic pick-ups and anchoring means 14 for the guitar strings 16, 17, 18 and 19. These are the first, third, fourth and fifth of the six strings indicated generally at 20, including second string 22 and sixth string 24. Except for the latter two strings, the parts thus far mentioned are conventional in every respect. All six strings, in conventional manner, are received in V-shaped notches formed on the upper surfaces of conventional bridge means indicated generally at 28. The other ends, not shown, of the strings are adapted to be attached to the conventional tuning pegs or equivalent means for adjustably tensioning the strings during tuning, all as is well known in the art.

The attachment of the present invention is indicated generally at 30 and includes an L-shaped bracket, typically of metal, having upper and lower flat legs 32 and 34 joining at a curved juncture or fold portion 36. Desirably the metal legs 32, 34 are provided with a lining 33, 35 of felt or similar fabric material to prevent scratching or marring the guitar surface. Lower bracket leg 34 has formed therein an opening 38 (see FIG. 3), which may desirably be in the form of a vertically elongated slot, for receiving therethrough the shank of a screw 40 threaded into the body of the guitar and typically provided for mounting the lower flanged strap attachment button 42.

Figure 2:
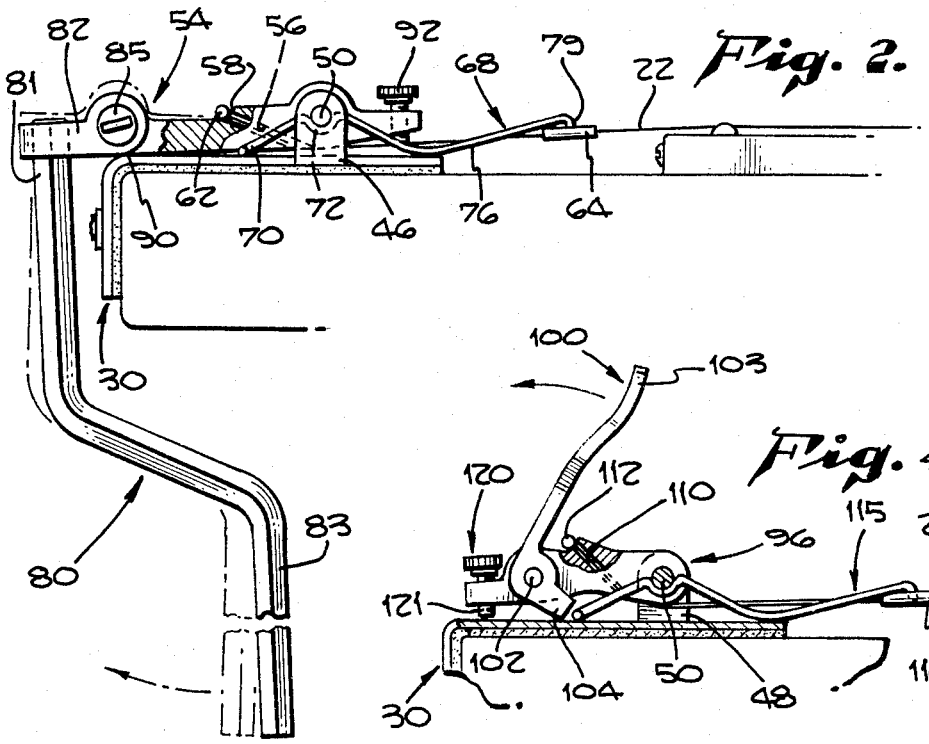
FIG. 2 is a fragmentary view, partially in section, taken on the arrows 2—2 of FIG. 1, showing the depending arm of the body-actuated mechanism in solid lines in its rest position, and in dotted outline when actuated by the performer's hip movement into its operative or pitch bending position.

Upper bracket leg 32 is provided with a pair of laterally spaced apertured upstanding support ears 46 and 48 for mounting a transverse rod 50, the rod being held against lateral movement by retaining means 52. A rocker arm indicated generally at 54 is pivotally mounted on the rod and is also held against lateral movement by similar retaining means 52. As best seen in FIG. 2, rocker arm 54 is provided with a string-receiving bore 56 which starts from a rear opening 58 behind and approximately horizontally aligned with the axis of rod 50, and extends downwardly and forwardly to a forward opening below the rod. The rear portion of second string 22 is threaded through the bore, with its enlarged anchor end 62 at the rear opening. String 22 is also threaded through a sleeve 64 made of a smooth material such as Teflon, for reasons later appearing, and from there extends forwardly to be attached to a tuning peg on the neck of the guitar in conventional manner.

Means are provided in accordance with the invention to impose downward resilient force on string 22 within sleeve 64 forwardly of bracket 30. Such means are here shown as including a spring wire clip indicated generally at 68 having a rear leg 70 bearing downwardly on bracket leg 32, a central yoke 72 bearing upwardly on rod 50, and a forward leg 74 having an intermediate portion bearing downwardly on bracket leg 32 and a front extension 76 provided with an in-turned finger 79 bearing downwardly on sleeve 64.

The rear portion of rocker arm 54 is provided with means for attachment to the upper end of an actuator arm indicated generally at 80 having an upper shank 81 clampably received in clamp 82 having set screw means 84 and a wingnut 85 for clamping the upper shank 81. Arm 80 includes an offset lower shank 83. It will be seen that by rotatably adjusting the upper shank in clamp 82, the performer can adjust the location of the lower shank as he individually prefers, in order to be conveniently actuable by the performer's body movement as previously mentioned.

As brought out by the dotted line showing in FIG. 2, it will be noted that movement of actuator arm 80 to its dotted line position will increase tension on string 22, and thereby bend its pitch upwardly.

Means are provided for limiting the amount of angular rocking motion of rocker arm 54. The limit of counter-clockwise rotation is fixed by abutting contact at 90 between the rear portion of the rocker arm and the upper face of the bracket, adjacent to the juncture portion 36. The limit of clockwise movement is selectively adjustable, and in the present form of the invention is established by a set screw indicated generally at 92 mounted on the forward end of the rocker arm, laterally offset somewhat from string 22. As will be seen, the limit of clockwise movement is established by abutment of the lower end of the shank of screw 92 and the upper face of bracket leg 32. Thus the user can adjust set screw 92 to provide the exact amount of bending desired.

A second bending mechanism may be provided in accordance with the invention, for bending the pitch of the sixth string 24. This mechanism is shown in the lower portion of FIG. 1 and in the detail views of FIGS. 3 and 4, and includes a rocker arm indicated generally at 96, pivotally mounted at its forward end on transverse rod 50 for rocking movement between its normal or rest position of FIG. 3 and its bending position of FIG. 4. Such movement is caused by arcuate motion of an actuator arm indicated generally at 100, pivotally connected at 102 with rocker arm 96, the pivotal axis 102 being substantially rearward of the axis of rod 50. Actuator arm 100 has a forwardly projecting relatively long portion terminating in an enlarged finger grip 103, and a relatively short portion 104 constituting a camming finger projecting downwardly from a point slightly to the rear of pivotal axis 102.

Figure 4:
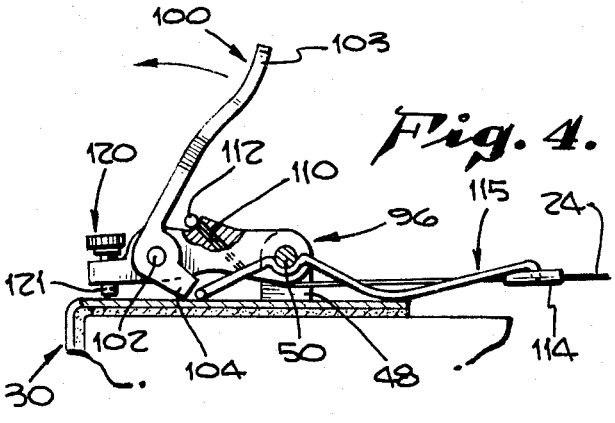
FIG. 4 is a view similar to FIG. 3 but showing the toggle actuator of the second bending device in its operative position for bending a string pitch downwardly.

As seen in the sectionalized portion of actuator arm 96 in FIG. 4, that arm has formed therein a string-receiving bore 110 for housing the rearmost portion of string 24. More specifically, the rear end of string 24 has a conventional enlarged anchor member 112, which is too large to be received into bore 110. String 24 extends therefrom forwardly and downwardly in bore 110 within arm 96, exiting the bore at a point substantially lower than and forwardly of anchor 112. String 24 thence extends forwardly through sleeve 114 of Teflon, or the like, corresponding to sleeve 64 previously described in connection with the first bending mechanism. Similarly also, means are provided for imposing a resilient downward force on sleeve 114, such means being here shown as a spring wire clip indicated generally at 115, corresponding in construction and function to wire clip 68 of the earlier described mechanism.

Figure 3:
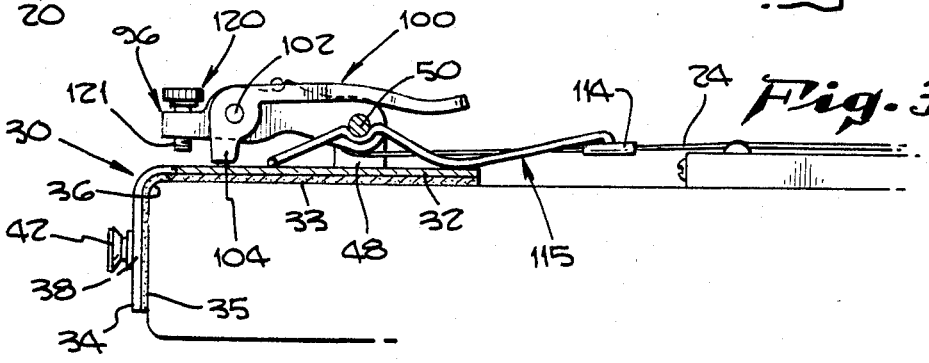
FIG. 3 is a fragmentary sectional view taken on arrows 3—3 of FIG. 1 showing the second bending device in its rest position.

Comparison of the normal or rest position of the parts shown in FIG. 3 and the pitch-bending position of FIG. 4 will clearly demonstrate the operation of the mechanism. It is to be noted that in the pitch-bending position of FIG. 4, the tension imposed on string 24 is lower than in the normal or rest position of FIG. 3. Thus this second mechanism bends the pitch of string 24 downwardly, contrary to the upward bending effect on string 22 first described herein.

Also, as in the case of the first described mechanism, means are provided for limiting the pivotal movement of rocker arm 96 between rest and bending positions, and thus for establishing the amount of bending to be created in the pitch of the string. Such means are here shown as including selectively adjustable means for establishing the limit of movement toward the bending position.

Specifically, such means include an adjustable set screw indicated generally at 120 threadedly connected to the distal end of rocker arm 96. The lowermost tip 121 of set screw 120 abuts the upper surface of bracket leg 32 to establish the upper limit of bending. As will be readily understood, the other limit of arcuate movement of rocker arm 96, after rearward camming movement of finger 104 along upper bracket leg 32 from its FIG. 4 position to its FIG. 3 position, is established by downward abutment of a distal portion of actuator arm 100 onto rocker arm 96, that abutted distal portion being here illustratively shown as being in substantial vertical alignment with rod 50.

The resilient downward force imposed on strings 22 and 24 by spring wire clips 68 and 115 bearing against sleeves 64 and 114 is desirable in order to avoid the possibility that one of the strings might slip or slide laterally out of its alignment notch in bridge 28 during changes in string tension in bending or returning from bending in accordance with the invention. It may be noted also that sleeves 64 and 114 are so constructed as to impose as little friction as possible on their respective strings. As a result, each of the strings, after being released from bending, will return to virtually exactly its original tension.

I claim:

1. A string bender for mounting on a stringed instrument of the guitar family having a set of tensioned strings and adapted to be carried by a performer in use with the strings lying adjacent to the forwardly directed face of the instrument, said device comprising:

a bracket adapted to be mounted on a guitar at its lower end including means anchoring a selected one of the tensioned strings;

means carried by the bracket for changing the tension imposed on the selected string;

and means actuable by body movement of the performer for actuating the changing means, said actuating means including an arm mounted on the bracket and projecting rearwardly from the lower end of the guitar.

2. A string bender device for selectively mounting on and demounting from a stringed instrument of the guitar family adapted to be carried by a performer in use and having a set of parallel tensioned strings extending upwardly from adjacent the lower end of the instrument and lying adjacent to the forwardly directed face of the instrument body, the lower end of the instrument body being provided with an existing opening for receiving the shank of a connecting element for selectively attaching one end of a supporting strap to the instrument body, said device comprising:

an L-shaped bracket and means for mounting the bracket on the lower end of the body, including an upper leg juxtaposed on a portion of the forwardly directed body face adjacent to said body lower end, and a lower leg extending normal to the upper leg in juxtaposed relation with the lower body wall and having formed therein an aperture registering with said body opening, said mounting means including a connecting element having a shank extending through the aperture and seated in the opening;

means carried by the bracket for anchoring the lower end of a selected one of the tensioned strings, including means for changing the tension imposed on the selected string;

and movable means for actuating the changing means, including an arm projecting rearwardly from the instrument adjacent said lower end and adapted to be moved by lateral body movement of the performer.

* * * * *